United States Patent [19]

Caumont

[11] Patent Number: 4,575,992

[45] Date of Patent: Mar. 18, 1986

[54] APPARATUS FOR PRODUCING CLOTH CUT OUTS FOR PACKAGING IN A CONTAINER TOGETHER WITH THE PRODUCTION AT A DIFFERENT RATE OF CLOSURE CUT OUT FOR THE CONTAINER

[75] Inventor: Jean-François Caumont, Brionne, France

[73] Assignee: Tempo Sanys, Paris, France

[21] Appl. No.: 163,706

[22] Filed: Jun. 27, 1980

[30] Foreign Application Priority Data

Oct. 11, 1979 [FR] France ..... 79 25358

[51] Int. Cl.[4] ..... B65B 7/28; B65B 63/00

[52] U.S. Cl. ..... 53/520; 53/129; 53/237; 53/298

[58] Field of Search ..... 53/157, 129, 520, 237, 53/298; 83/272

[56] References Cited

U.S. PATENT DOCUMENTS

| | | | |
|---|---|---|---|
| 2,175,338 | 10/1939 | Booth | 53/298 X |
| 3,152,428 | 10/1964 | Hill | 53/520 X |
| 3,739,671 | 6/1973 | Keith | 83/272 X |
| 3,792,566 | 2/1974 | Kinney | 53/298 |
| 3,959,951 | 6/1976 | Paules | 53/157 |

FOREIGN PATENT DOCUMENTS

| | | | |
|---|---|---|---|
| 454614 | 10/1936 | United Kingdom | 53/129 |

*Primary Examiner*—John Sipos
*Attorney, Agent, or Firm*—Louis Orenbuch

[57] ABSTRACT

This invention concerns an apparatus for cutting out discs or another shape of material in fibre form, for example cotton, and for cutting out and closing small bags filled with said discs, by a cover of the same shape, the apparatus being provided with a punch member co-operating with a die receiving a first sheet of cotton to be cut out, which is entrained with a translatory stepping movement.

1 Claim, 2 Drawing Figures

APPARATUS FOR PRODUCING CLOTH CUT OUTS FOR PACKAGING IN A CONTAINER TOGETHER WITH THE PRODUCTION AT A DIFFERENT RATE OF CLOSURE CUT OUT FOR THE CONTAINER

The present invention concerns apparatus for cutting out discs or another shape of material in fibre form, for example of cotton, and for cutting out and closing small bags filled with such discs, by a cover of the same shape.

In recent years, there has appeared on the market discs, or another shape, of cotton material, which are sold in small tubular bags or sachets, containing approximately twenty four discs one upon the other. These discs which are used in particular for removing makeup have immediately had a good reception by the public.

In order further to improve the commercial spread of such discs, it is necessary for the cost of production thereof to be reduced in order to enable them to be marketed at a price which is attractive for customers.

Moreover, in order for the packs or bags of discs to be properly presented, they must be closed by a disc of the same size as the cotton discs and comprising a material of minimum stiffness.

In order to improve the production conditions, apparatus has been proposed which, to give a description in basic diagrammatic form, comprises a punch member B co-operable with a die A which receives a sheet or web of cotton C which is entrained over the die A by an accompanying motor, with a stepping movement at a given frequency f.

In order to control the position of the sheet C with respect to the die A and the punch member B, it is passed between drive rollers D.

At a given frequency, pulses are passed to the punch member B which carries out a striking movement which is such as to cut out from the cotton web C a disc E which then falls into a tubular member F which is especially provided for that purpose below the die A, with a movement as indicated by arrow X, and is then collected in a bag (not shown) disposed below the member F.

In order to permit these bags or packs to be closed, which is generally a manual operation, disposed upstream of the punch member B with respect to the direction of movement Y of the web C is a means G for distributing cardboard discs H' which have been previously cut out in the same size as the cotton discs E which are cut out by the punch member B.

The distribution means G is a pneumatic slider-type device controlled so as to distribute a disc H' onto the web C at predetermined intervals of time, in such a way that said disc is below the punch member B at a moment at which the bag or pack contains the desired total number of cotton discs.

This arrangement is not without many disadvantages, because on the one hand the cost price of the cardboard closure discs which are the subject of a preliminary cutting-out operation is relatively high and, on the other hand, control of the distribution means H must be extremely accurate and therefore expensive in order for the cardboard disc H' to be below the punch member B precisely at the predetermined moment.

Moreover, it is extremely difficult to ensure that the disc H' is precisely below the punch member B and there is uncertainty in regard to the positioning thereof, so that, in the punching action, there is a danger of the punch member B cutting off a part of the disc H', and thus there will always remain a small amount of cardboard waste in the cotton web, after the discs E have been cut out. For this reason, it will not be possible for the cotton web to be re-used directly.

The aim of the present invention is to overcome the above-indicated disadvantages by proposing an apparatus for cutting out discs or another shape, of material in fibre form, for example cotton, and for cutting out and closing small bags filled with such discs, by a cover of the same shape, of a novel type which avoids all the adjustment operations required in order to arrive at satisfactory positioning of the closure discs, thereby making it possible substantially to reduce the cost of the discs.

For this purpose, the present invention concerns an apparatus which is provided with a punch member co-operating with a die receiving a first web or sheet of cotton to be cut out, which web or sheet is driven with a translatory stepping movement, characterised in that the apparatus comprises a second web or sheet of closure material which is entrained with a stepping movement at a frequency lower than the frequency of movement of the first web and corresponding to the number of discs contained in the bag. This specification concerns more particularly cotton discs but it will be appreciated that it would also be possible to provide for other shapes (triangles, cones, etc.), without thereby departing from the scope of the invention.

Consequently, in accordance with the invention, two webs or sheets are used, namely a first sheet of cotton and a second sheet of closure material, which sheets advance in a predetermined fashion relative to each other. Under these conditions, it is no longer necessary to provide a pneumatic distribution means which is always a high-cost item. Moreover, as there are two webs or sheets, the positions of the sheets relative to each other and relative to the punch member can be determined with a lesser degree of accuracy.

The closure material used may be any material, for example cardboard, ABS, . . . but preferably, and in accordance with another feature of the invention, the closure material comprises high-density polyethylene, which thus makes it possible to produce closure discs whose cost is markedly lower than the cardboard closure discs used in the prior art.

In accordance with another feature of the invention, the ratio between the frequency of movements of the first and second sheets or webs corresponds to the number of discs contained in a bag or pack.

Consequently, when bags containing approximately twenty four discs are to be produced, the frequency of movement of the cotton web or sheet is to be twenty four times greater than the frequency of movement of the polyethylene web or sheet.

In order further to increase the profitability of the apparatus, and in accordance with another feature of the invention, it is possible to provide a plurality of punch members which are actuated jointly, for example three punch members, which strike against a die having three apertures, thereby making it possible simultaneously to produce three cotton discs which will be separately passed to three bags or packs, by way of three tubular conduit members.

The apparatus which is the subject of the present invention will be described in greater detail with reference to the accompanying drawings wherein.

Figure 1:
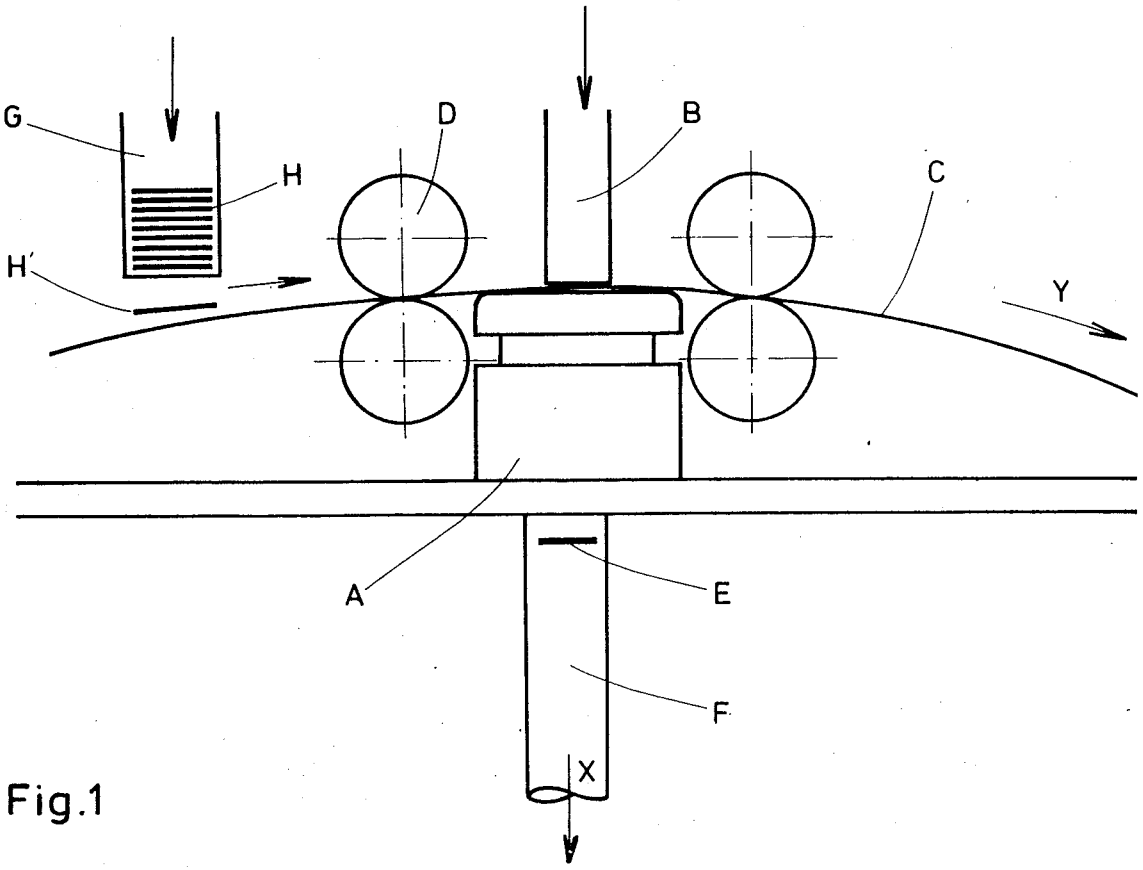
FIG. 1 shows an apparatus in accordance with the prior art.
Figure 2:
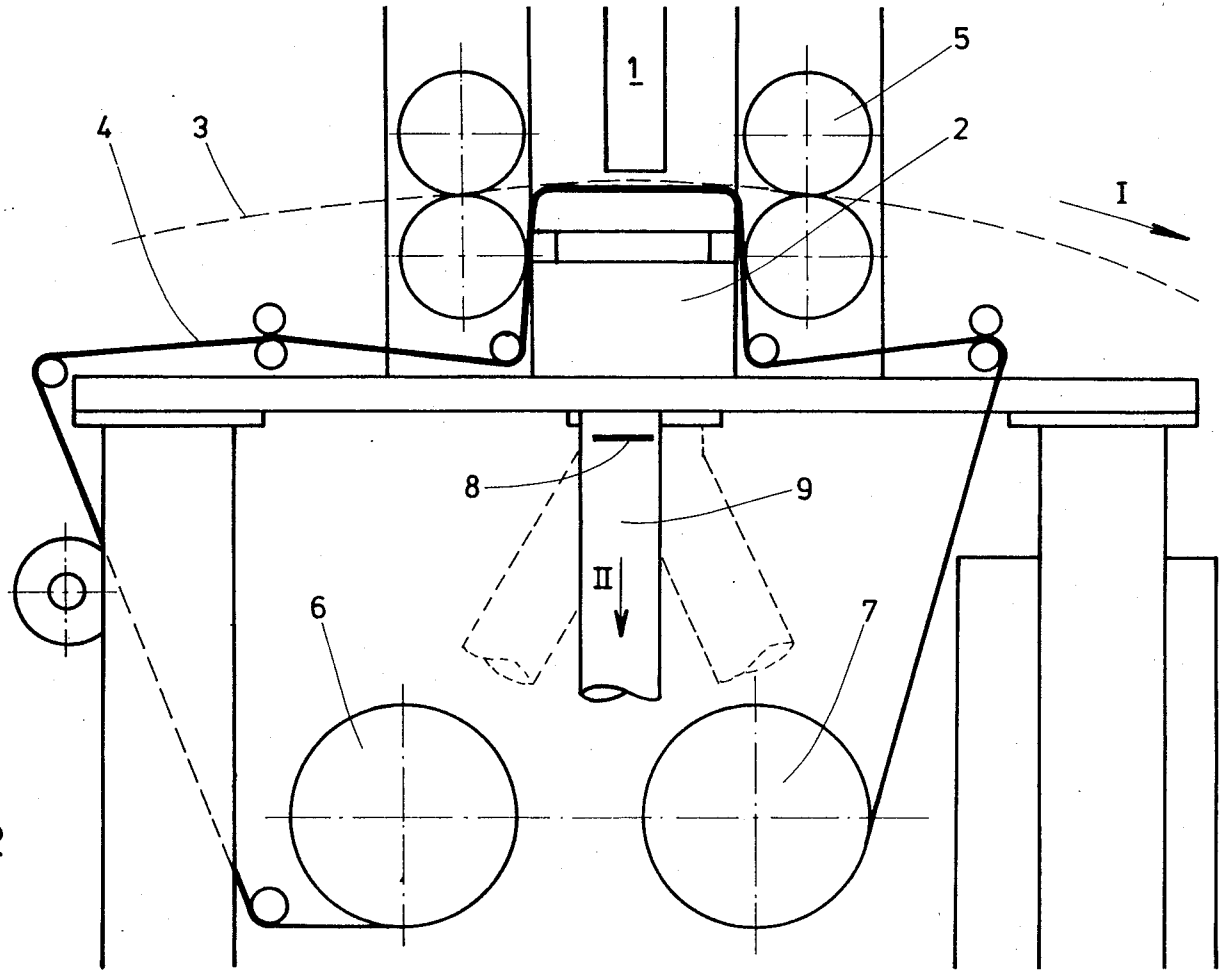
FIG. 2 shows the apparatus according to this invention.

Referring to FIG. 2, the apparatus according to the invention primarily comprises a punch member 1 which co-operates with a die 2 having apertures (not shown) whose dimensions correspond to those of the desired discs and over which are passed two movable webs or sheets as indicated by arrow I, namely a first sheet 3 formed by a cotton sheet and a second sheet 4 formed by a polyethylene sheet, which advances with a stepping movement at a pre-determined frequency relative to the advance movement of the sheet 3.

The cotton sheet 3 is positioned relative to the die 2 and the punch member 1 by rollers 5 which likewise serve to position the sheet 4 which is unwound from rolls 6 and which is then rolled on a drive roll 7.

The punch member is so adjusted as to carry out a striking movement, for each forward step movement of the cotton sheet 3.

In order to produce bags or packs comprising twenty four cotton discs, the frequency of movement of the closure material sheet, which is preferably high-density polyethylene, must be twenty four times lower than the frequency of the stepping movement of the sheet 3.

Thus, and in contrast to what happened in the prior art, all the striking movements of the punch member 1 are effective and moreover the apparatus always produces a closure disc which is perfectly round in shape, thereby making it possible to produce bags which enjoy satisfactory aesthetic characteristics and moreover a cotton web or sheet which, after being used, does not have any polyethylene waste and therefore can be immediately re-used.

After the cutting-out operation, the cotton discs 8 are introduced into conduits 9 which pass them in the direction indicated by arrow II into bags (not shown) which are then closed manually each time that a closure disc from the sheet or web 4 is received.

In order further to improve the speed of production of the bag, it is possible to provide an apparatus similar to that described above, but comprising three paired punch members co-operating with a die comprising three apertures corresponding to punch members, wherein the discs, after having been cut out, are passed simultaneously into three conduits of which two are shown in broken line in FIG. 2.

I claim:

1. Apparatus for cutting out discs or other shapes from a cloth sheet, for filling containers with the cut-outs, and for cutting out a closure member of the same shape from a sheet of closure material, said apparatus comprising (a) a die having an opening of the requisite shape, (b) a punch arranged to cooperate with the die to cut out material disposed in the gap between the punch and the die (c) first stepping means for stepping the sheet of cloth material through the gap between the punch and die at a first frequency, and (d) second stepping means for stepping the sheet of closure material through the gap between the punch and die at a second frequency lower than said first frequency, said first and second stepping means including means for causing the two sheets of material to be disposed one over the other when in the gap between the punch and the die whereby a cloth cut out and a closure cut out are produced in one stroke of the punch followed by a sequence of strokes in which only cloth cut outs are produced.

* * * * *